US012780363B2

(12) United States Patent
Strong

(10) Patent No.: US 12,780,363 B2
(45) Date of Patent: Nov. 3, 2026

(54) DRILLED ANCHOR PILE

(71) Applicant: REFLEX MARINE LTD, Bristol (GB)

(72) Inventor: Philip Strong, Bristol (GB)

(73) Assignee: REFLEX MARINE LTD, Bristol (GB)

( * ) Notice: Subject to any disclaimer, the term of this patent is extended or adjusted under 35 U.S.C. 154(b) by 323 days.

(21) Appl. No.: 18/683,259

(22) PCT Filed: Jul. 19, 2022

(86) PCT No.: PCT/GB2022/051859
§ 371 (c)(1),
(2) Date: Feb. 13, 2024

(87) PCT Pub. No.: WO2023/031576
PCT Pub. Date: Mar. 9, 2023

(65) Prior Publication Data

US 2025/0136249 A1 May 1, 2025

(30) Foreign Application Priority Data

Aug. 31, 2021 (GB) ..... 2112355

(51) Int. Cl.

| | |
|---|---|
| ***B63B 21/26*** | (2006.01) |
| ***E02D 5/54*** | (2006.01) |
| ***E02D 27/50*** | (2006.01) |
| ***E02D 27/52*** | (2006.01) |

(52) U.S. Cl.
CPC ..... *B63B 21/26* (2013.01); *E02D 5/54* (2013.01); *E02D 27/50* (2013.01); *E02D 27/525* (2013.01)

(58) Field of Classification Search
CPC ..... B63B 21/00; B63B 21/26; E02D 5/54; E02D 27/50; E02D 27/52; E02D 27/525
USPC ..... 114/294
See application file for complete search history.

(56) References Cited

U.S. PATENT DOCUMENTS

| | | | |
|---|---|---|---|
| 6,223,671 | B1 | 5/2001 | Head |
| 2011/0041752 | A1 | 2/2011 | LaCivita |

FOREIGN PATENT DOCUMENTS

| | | | |
|---|---|---|---|
| CA | 2968930 | A1 | 6/2016 |
| GB | 2355039 | A | 4/2001 |
| WO | 8601556 | A1 | 3/1986 |

*Primary Examiner* — Lars A Olson
(74) *Attorney, Agent, or Firm* — Jose Cherson Weissbrot

(57) ABSTRACT

The present invention relates to an anchoring system (1) comprising an anchor pile (2) configured to be embedded in a borehole (30) drilled in the seabed. The anchor pile (2) comprises an elongate main body (3) having a longitudinal axis (L) and comprising an upper end (4) and a lower end (5). The cross section of the elongate main body (3) increases along a portion of the longitudinal axis (L) in the direction from the upper end (4) to the lower end (5) defining at least one bearing surface (7*a*, 7*b*) such that in use an annular gap (32) for receiving locking media is defined between the at least one bearing surface (7*a*, 7*b*) and the adjacent portions of the borehole (30). The anchor pile (2) is locked in position within the borehole (30) on receipt of locking media within the annular gap (32) and abutment of the loose material with the bearing surface (7*a*, 7*b*).

19 Claims, 10 Drawing Sheets

DRILLED ANCHOR PILE

The present invention relates to an anchoring system, particularly for use in subsea applications. The anchoring system is suitable for use as a mooring termination point or anchor in the seabed. The invention further relates to a method of installing such an anchoring system.

A variety of anchoring systems are known in the art, such as driven piles, suction piles, and drag embedment. Such systems have however been found to suffer from several disadvantages. Commonly used anchoring systems are, typically, limited for use with specific seabed soil types, and/or have high associated cost and time implications.

For Floating Offshore Wind (FOW) projects, the geological conditions can vary greatly across a single site. As a result, conventional anchoring systems may not be suitable for use across the whole of the site. Furthermore, FOW projects require a large number of anchor foundations and as such there are high associated costs for using conventional anchoring systems.

It is among the objectives of embodiments of the present invention to obviate or alleviate these and other disadvantages of known anchor piling systems.

According to a first aspect of the present invention, there is provided an anchor piling system comprising:

an anchor pile configured to be embedded in a borehole drilled in the seabed, the anchor pile comprising an elongate main body, optionally comprising one or more joints formed along the elongate main body, the elongate main body having a longitudinal axis and comprising an upper end and a lower end, wherein the upper end is configured in use to be fully submerged within the borehole;

one or more portions located on the elongate main body of the anchor pile, the one or more portions each having a cross section greater than the cross section of the elongate main body and optionally the one or more joints formed thereon, in which the cross section of the one or more portions increases along a portion of the longitudinal axis in the direction from the upper end to the lower end of the elongate main body thereby defining at least one bearing surface such that in use an annular gap for receiving locking media is defined between the at least one bearing surface and the adjacent portions of the borehole, and in which the anchor pile is locked in position within the borehole on receipt of locking media within the annular gap as a result of sufficient frictional resistance arising from the abutment of the locking media with the bearing surface and suitable load bearing soil layers of the borehole.

According to a second aspect of the present invention, there is provided an anchoring system kit comprising:

an anchoring system as herein described; and locking media.

According to a third aspect of the present invention there is provided a method of installing an anchor pile into a borehole drilled in the seabed for creating a mooring anchorage, the method comprising the steps of:

i. providing an anchoring system as herein described; and ii. at least partially filling the annular gap defined between the bearing surface of the elongate main body of the anchor pile and the adjacent borehole wall with locking media to lock the anchor pile in place.

The present invention provides an anchoring system which can be inserted into and secured in place within a bore with locking media. The present invention therefore provides an efficient and reliable method of securing an anchoring system within a bore using locking media. The anchoring system is very reliable and is adaptable to support a wide range of loads, for example loads of at least 100 tonnes, up to in excess of 1000 tonnes.

The present invention provides an anchoring system which is capable of accepting vertical and lateral loads, for example of greater than 1000 tonnes, imposed by for example a mooring line.

As the anchoring system of the present invention is provided in-line with the bore hole, the system may be used for high angle loading, including for example angles of up to vertical loading.

The anchoring system of the present invention is maintained securely within the borehole, using low-cost consumables and also having reduced environmental impact compared to conventional anchoring mechanisms.

The anchoring system of the present invention, due to geometry or profile, is configured to rely upon friction derived from the introduction of locking media into the defined annular gap to provide sufficient resistance, and may also be secured by setting material.

The profile (for example the angle) of the bearing surface of the one or more portions is preferably optimised to transfer a maximum compressive load through the frictional resistance arising as a result of the received locking media to create hoop stresses in the surrounding substrate in the borehole wall when the anchor pile is subject to tensile loading.

The profile along the longitudinal axis of the elongate member may be geometrically varied such that there may be changes in the diameter or cross section of the elongate member between any two points on the longitudinal axis. Such changes in diameter or cross section along the longitudinal axis may thus form tapered or shaped sections such as regular or irregular radial sections or box sections such as for example square box sections, conduits such as for example radial conduits, corrugations, or any other geometrical surface shapes which may be required.

The upper end of the elongate member of the anchoring system of the present invention is preferably fully submerged within the borehole, i.e. located within the borehole beneath the seabed.

The anchoring system of the present invention is configured to provide a deeply embedded anchor pile. The anchoring system of the present invention may for example be used in offshore applications. The anchoring system of the present invention may for example be used in deepwater environments.

The anchoring system of the present invention is preferably located between 2 to 3 times deeper within the borehole than conventional anchoring systems which are all embedded within the upper soil. In contrast, the anchoring system of the present invention is configured to be embedded beneath the upper soil portion of the borehole. The embedment depth of the anchoring system is defined as being the depth of the lower end of the elongate member of the anchor pile within the borehole. The embedment depth of the anchoring system of the present invention can be required to engage with suitable load bearing soil layers, located for example 100 metres or more below the seabed. In comparison, the embedment depth of conventional pile anchoring systems, such as driven pile and suction pile anchors, is typically about 10 to 20 metres beneath the seabed and with the pile top typically positioned near to seabed level.

The one or more joints include coupling joints for connecting adjacent elongate member portions to provide the elongate member.

Preferably, the bearing surface of the elongate member comprises at least one tapered section. The angle of each tapered section may be selected and/or modified in accordance with the particular requirements for the anchoring system, for example in accordance with the site soil conditions and pile design requirements. For example, the optimised angle of each tapered section of the bearing surface extends preferably at an angle of at least 2 degrees to a plane extending normal or transverse to the longitudinal axis of the elongate member. Preferably, the optimised angle of each tapered section of the bearing surface is no more than 10 degrees to a plane extending normal or transverse to the longitudinal axis of the elongate member, Preferably, the optimised angle of each tapered section of the bearing surface is between 2 and 10 degrees to a plane extending normal or transverse to the longitudinal axis of the elongate member.

The tapered section(s) may be configured to extend radially outwardly from the longitudinal axis of the elongate main body. For example the tapered section(s) may be configured to extend radially outwardly from the longitudinal axis of the elongate main body in a direction extending towards the base of the bore hole such that the greatest diameter of the tapered section is at or adjacent the lower end of the tapered section.

In one embodiment, the anchoring system may comprise one or more, preferably a plurality of, outwardly extending body portions, extending away from the longitudinal axis of the elongate main body.

The outwardly extending body portion(s) may extend at any suitable angle away from the longitudinal axis of the elongate main body. For example, the outwardly extending body portion(s) may be radially outwardly extending body portions.

The outwardly extending body portions are preferably spaced apart from each other along the length of the system. It is to be understood that the elongate main body may contain any suitable number of outwardly extending body portions depending on the particular requirements for the installation. The plurality of outwardly extending body portions may be equidistantly spaced apart from each other.

Each outwardly extending body portions may have any suitable shape and/or dimension.

The plurality of outwardly extending body portions may have identical shapes and/or dimensions to one or more, preferably each, other body portion(s).

In one embodiment, the or each outwardly extending body portion comprises at least one box section, for example square box section, projecting radially outwardly from the elongate main body and/or at least one angled face sloping down outwardly from the elongate main body. The elongate main body may comprise outwardly extending body portion(s) having any geometrical shape, in which the outwardly extending body portion(s) provides at least one face which extends at an angle to the longitudinal axis of the elongate main body.

The one or more outwardly extending body portions are preferably considered to be distinct from one or more joints provided between adjacent elongate main body portions (configured to connect elongate main body portions to provide the elongate main body). It is known for one or more joints in an elongate main body of an anchor pile to include a tapered upper surface. However, this tapered upper surface of the joint(s) is not considered to be a bearing surface capable of transferring compressive load through the locking media into the substrate of the borehole wall.

Preferably, the elongate main body, for example one or more, preferably each, outwardly extending body portion, comprises at least one conduit configured to provide a flow path to enable fluid flow across the surface of the elongate main body, for example across the surface of the outwardly extending body portion. The at least one conduit may extend at any suitable angle relative to the longitudinal axis of the elongate main body.

The at least one conduit preferably defines a channel or groove between an upper section and a lower section of the elongate main body and/or of the outwardly extending body portion.

Preferably, the at least one conduit is arranged essentially parallel to the longitudinal axis of the elongate main body, such that the conduit extends along a portion of the longitudinal axis of the elongate main body along which the cross section of the elongate main body increases.

In one embodiment, the elongate main body comprises at least one outwardly extending body portion comprising:

- a first conical portion coaxial with the longitudinal axis of the elongate main body, wherein along the first conical portion the cross section of the elongate body increases in the direction from the upper end to the lower end thereof; and
- a second conical portion coaxial with the longitudinal axis of the elongate main body, wherein along the second conical portion the cross section of the main body decreases in the direction from the upper end to the lower end thereof.

In one embodiment, the elongate main body comprises at least one outwardly extending body portion comprising:

- a first conical portion coaxial with the longitudinal axis of the elongate main body, wherein along the first conical portion the cross section of the elongate body increases in the direction from the upper end to the lower end thereof;
- second conical portion coaxial with the longitudinal axis of the elongate main body, wherein along the second conical portion the cross section of the main body decreases in the direction from the upper end to the lower end thereof; and
  - a tubular portion coaxial with the longitudinal axis (L) of the elongate main body, extending between the first conical portion and the second conical portion.

Preferably, the first conical portion provides the bearing surface(s).

Preferably, the taper angle of the first conical portion is smaller than the taper angle of the second conical portion.

The taper angles of the first and second conical portion may be any suitable angle depending on the particular requirements of the elongate main body of the anchoring system. In one embodiment, the taper angle of the first conical portion may be equal to the taper angle of the second conical portion.

The taper angle of the second conical portion may be selected to aid and/or improve the ease of introduction of the elongate main body into the borehole.

The taper angle of the first conical portion is selected to provide an annular space of sufficient height to ensure efficient anchorage of the anchoring system.

Each conical portion has a first free end and a second opposed end located at or adjacent the other conical portion or the tubular portion. The length of a conical portion is measured between the first free end and the second opposed end. It is to be understood that each conical portion may have any suitable length depending on the particular requirements of the elongate main body of the anchoring system.

Preferably, the first conical portion extends along a greater length of the elongate main body than the second conical portion.

The elongate main body preferably comprises at least one conduit extending along at least a portion of the first conical portion, at least a portion of the second conical portion, and along the tubular section (if present).

The elongate main body portion preferably comprises at least one conduit arranged essentially parallel to the longitudinal axis (L) of the elongate main body, the conduit extending along: at least a portion of the first conical portion, at least a portion of the second conical portion, and the tubular section (if present).

Preferably, at least a portion of the elongate main body of the anchor pile comprises a cohesive high friction coating configured to increase friction between the elongate main body and locking media received within the annular gap provided between the borehole wall and the portion of the longitudinal axis of the elongate main body along which the cross section of the elongate main body increases.

Preferably, the cohesive high friction coating is provided on the bearing surface(s), for example on the tapered surface(s) and/or tapered section(s).

Preferably, the cohesive high friction coating is provided on the first conical portion, and optionally on the tubular portion. Preferably the second conical portion is free of a cohesive high friction coating.

The cohesive high friction coating may be any coating capable of increasing the friction between the bearing surface of the elongate main body and the locking media. Preferably, the cohesive high friction coating is provided as a layer, as a sheet or in granular form. The cohesive high friction coating may be applied to the bearing surface or otherwise connected to the bearing surface by any suitable means along a predetermined length of the longitudinal axis of the elongate main body. Preferably, the cohesive high friction coating is applied to the portion of the longitudinal axis of the elongate main body along which the cross section increases. The cohesive high friction coating may be applied along at least a portion of one or more outwardly extending body portions. Preferably, the cohesive high friction coating comprises bitumen or any other suitable material.

In one embodiment, at least a section of the or each elongate main body comprises fixing means operative to penetrate an adjacent portion of a borehole wall to establish a fixed mechanical connection between the elongate main body of the anchoring system and the adjacent soil strata of the borehole wall.

Preferably, the fixing means are operative to be driven outwardly or away from the elongate main body to penetrate an adjacent portion of a borehole wall.

The fixing means may for example comprise at least one extending element. The at least one extending element may have a pointed, for example cone pointed profile. The extending element(s) may for example comprise cone point bolts.

The or each outwardly extending body portions may comprise one or more, preferably a plurality of, fixing means. The fixing means may be spaced apart from each other along the length of the elongate main body. The fixing means may be spaced apart from each other along the length of the outwardly extending body portions. The elongate main body, for example the or each outwardly extending body portion, may comprise any suitable number of fixing means.

One or more of the plurality of fixing means are preferably configured to extend at different angles with respect to the longitudinal axis of the elongate main body. The fixation of the elongate main body may be improved by the use of a plurality of fixing means which extend at a plurality of different angles from the elongate main body.

The elongate main body of the anchor pile is preferably shaped as an essentially tubular hollow body comprising a plurality of ports arranged over at least a portion of its length. The ports are preferably configured for establishing a fluidic communication between an inner volume of the elongate main body and the annular gap defined between the elongate main body and the adjacent portion of the borehole. The port(s) may be provided by one or more outwardly extending body portions.

Preferably, the anchoring system further comprises a mooring line termination point for connection to a mooring line. In one embodiment, the mooring line termination point of a mooring line is integrally connected to the upper end of the elongate main body of the anchor pile. The mooring line termination point is preferably concentric and axially aligned with the longitudinal axis (L) of the connected elongate main body. The mooring line termination point may be radially offset from the anchor pile upper end to enable a path for pumped fluids to be established around or through the elongate main body.

In one embodiment, the anchoring system further comprises a guide tube configured for being releasably coupled by a distal end of the guide tube to or adjacent an upper end of the elongate main body.

In one embodiment, the anchoring system further comprises:

a guide collar configured for being arranged at the opening of the borehole, the guide collar providing an open ended guide channel configured in use to be aligned with the borehole and to enable the anchor pile to pass therethrough into the borehole, and in which the guide collar is configured to be removable from the anchor pile, for example from the mooring line, once positioned within the borehole.

In one embodiment, the guide collar may comprise a first end configured to contact the borehole, and a second opposed end. The guide collar may further comprise a slot extending between the first and second ends thereof, in which the slot is in communication with the guide channel. The slot is preferably configured to enable a mooring line to pass therethrough.

Preferably, the slot extends essentially parallel to the longitudinal axis of the guide collar, for example essentially parallel to the longitudinal axis of the guide channel.

The guide collar may comprise a conical section. The guide collar may be composed of brittle or deformable material.

The guide channel may be substantially centrally located. The guide channel may be composed of brittle or deformable material.

Preferably, the method of installing an anchor pile into a borehole, for example a borehole drilled in the seabed for creating a mooring anchorage, further comprises running the anchor pile through the borehole until the anchor pile is entirely received within the borehole prior to insertion of locking media. In one embodiment, the anchor pile contacts the bottom of the bore hole.

Preferably, the method of installing the anchor pile is carried out in a "single pass" involving drilling a borehole, inserting the anchor pile, and subsequently locking the anchor in position on insertion of locking media into the annular gap defined between the bearing surface of the one or more portion(s) of the elongate main body of the anchor pile and the adjacent borehole wall.

In use, locking media is introduced into the annular gap defined between the bearing surface of the elongate main body and the adjacent borehole wall to the elongate main body in position at a predetermined depth within the borehole. Locking media is introduced into the annular gap such that a portion of the borehole height is filled with locking media and the bearing surface of the elongate main body, for example provided by one or more outwardly extending body portion(s), are covered to a sufficient extent, for example completely covered, to provide adequate locking.

The locking media may for example comprise one or more of: loose aggregate material, grout, cement, or any combination thereof.

Preferably, the method of installing the anchor pile further comprises:

iii. introducing the lower end of the elongate main body through the guide channel of the guide collar, into the borehole; and iv. removing the guide collar from the anchor pile.

Preferably, the method of installing the anchor pile further comprises:

iii. introducing the elongate main body through the guide channel of the guide collar and into the borehole until the elongate main body is installed at a predetermined depth within the borehole; and iv. once the elongate main body is locked in position by introducing locking media into the annular gap, removing the guide collar from the anchor pile.

The locking media may be provided in a fluid medium directly into the annular gap from an upper section of the borehole.

Preferably, the elongate main body of the anchor pile is shaped as an essentially tubular hollow body.

Locking media may be provided as fluid and/or slurry pumped from inside the borehole through the hollow tubular main body.

In one embodiment, the elongate main body comprises one or more, preferably a plurality of, ports arranged over at least a portion of its length. The or each port is preferably configured for establishing a fluidic communication between an inner volume of the elongate main body and the annular gap(s). Locking media may be provided into the annular gap in a fluid medium through the elongate main body, preferably through the upper end of the elongate main body (for example hollow tubular main body). The fluid may for example be pumped through the inner volume of the main body through the port(s) to provide the locking media in a fluid medium into the annular gap(s).

The anchoring system of the present invention provides, in one embodiment, unique fluid placement methodology in which the locking media is provided to fill the borehole, and the annular gap(s) preferentially, and preferably sequentially, from the lower end of the anchor pile upwards towards the upper end of the anchor pile. This is achieved by providing an elongate main body comprising a plurality of ports arranged over at least a portion of its length, in which the size of the ports (for example the maximum diameter of the ports) decrease with distance away from the lower end of the elongate main body. With this arrangement, the supplied locking media preferentially exits the elongate main body through the largest ports located towards the lower end of the elongate main body. As the locking media fills the annular gap at or adjacent the largest ports towards the lower end of the elongate main body, the increased pressure causes the locking media to exit through slightly smaller ports provided further along the elongate main body in a direction towards the upper end thereof. The present invention therefore provides an anchoring system which can be used to efficiently and reliably fill annular gaps formed between multiple bearing surfaces located along the length of the elongate main body and adjacent portions of the borehole. The present invention is therefore able to securely fix the anchor pile in position within the borehole.

Preferably, the method further comprises providing locking media into the borehole prior to driving the anchor pile into the borehole.

It is to be understood that the geological structure changes along the depth of the bore hole. In one embodiment, during installation and anchoring of the structure, the anchoring system is configured such that at least a portion of the mooring line is placed under sufficient tension to cut through the surrounding geological material.

The elongate main body is preferably installed at a predetermined embedment depth, in which the entire elongate main body is received within the borehole. The upper end of the elongate main body is located within the borehole at a predetermined distance beneath the seabed surface. Due to the elongate main body being entirely received within and locked within the borehole, the mooring line, as a result of being subjected to tensile loads, forms a catenary profile through the soil strata located between the seabed surface and above the upper end of the elongate main body. The mooring line transfers tensile loads into the adjacent soil formation by frictional engagement with and bearing against soil strata. As a result of the catenary profile of the mooring line, the anchoring system of the present invention will be subjected to significantly reduced axial loads The axial reduction in loads on the elongate main body may be increased by increasing the effective diameter to increase the load bearing surface of the mooring line.

Preferably, the anchoring system further comprises a protective sheath configured to surround and protect at least a portion of the mooring line, for example at least the entire length of the mooring line configured to be inserted into the bore hole. The protective sheath is preferably configured to protect the mooring line from damage due to frictional forces and/or abrasion from surrounding geological material. The protective sheath may be, for example, composed of a steel wrap, thermoplastic or cross wound (braided) steel components or a combination of similar components The protective sheath may increase the load bearing surface of the mooring line whilst also increasing the frictional resistance. Additionally, the protective sheath may incorporate load bearing components such as steel plates or similar to increase bearing load against the soil strata and further reduce axial loads at the anchor pile. Alternatively, such load bearing components may be directly attached to the mooring line.

In one embodiment, the present invention provides an anchoring system configured for progressive failure. The anchoring system is configured to not provide catastrophic failure. In particular, the elongate main body is entirely received and secured, by aggregate, within a borehole. During peak load, the aggregate materials (which act as a quasi-fluid) and the elongate main body may move or become dislodged axially along the borehole. Each time the peak load drops below a certain level, the locking media resets within the annular gap and locks the elongate main body in position within the borehole whilst continuing to exert a high frictional force on the bearing surface of the elongate main body.

These and other aspects of the present invention will now be described, by way of example, only with reference to the accompanying figures, in which.

DETAILED DESCRIPTION

Figure 1:
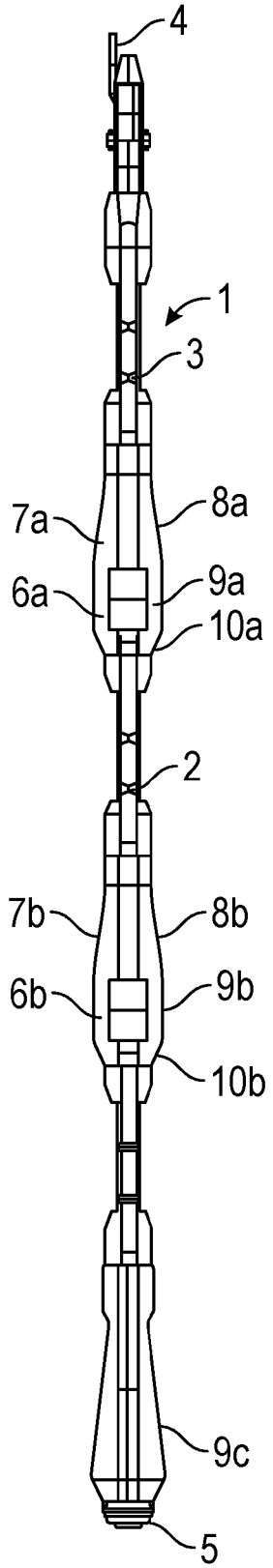
FIG. 1 shows a schematic illustration of a cross-sectional view of an anchoring system according to one embodiment of the present invention.
Figure 2:
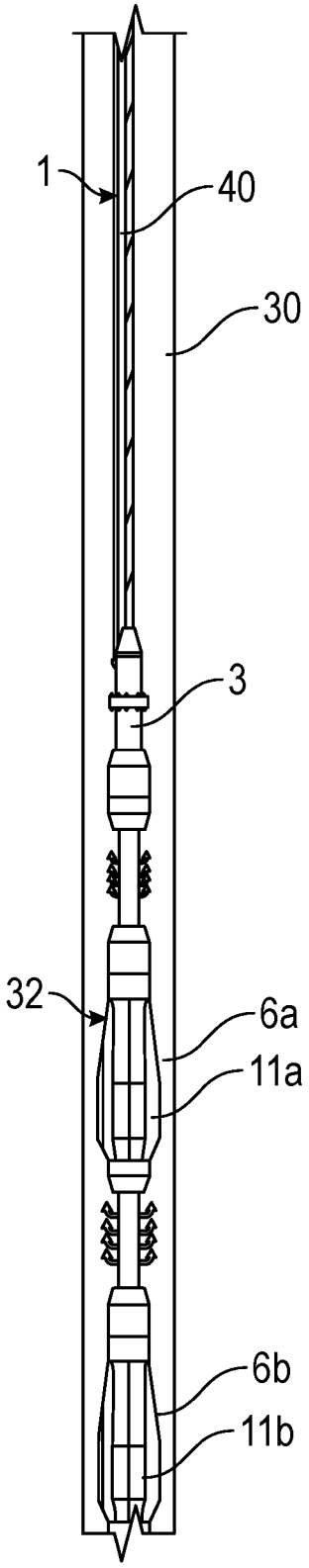
FIG. 2 shows a schematic illustration of the anchoring system of FIG. 1 within a borehole.

With reference to the Figures, the anchoring system 1 comprises an anchor pile 2 configured to be embedded in a borehole 30 drilled in the seabed. The anchor pile 2 comprises an elongate main body 3 having a longitudinal axis and comprising an upper end 4 and a lower end 5.

The elongate main body 3 comprises two spaced apart outwardly extending members 6*a*, 6*b*. The two outwardly extending body members 6*a*, 6*b* can be seen to be approximately equidistantly spaced along the length of the elongate main body 3. It is however to be understood that the members 6*a*, 6*b* may be provided at any suitable locations on the elongate main body 3.

It can be seen that the cross section of the elongate main body 3 increases at each of these two outwardly extending body members 6*a*, 6*b* in a direction extending along the longitudinal axis from the upper end 4 to the lower end 5 thereof.

Although the illustrated embodiment has two spaced apart outwardly extending body portions 6*a*, 6*b*, it is to be understood that the anchoring system 1 may comprise any suitable number of outwardly extending body portions 6*a*, 6*b*. For example, the system 1 may comprise a single outwardly extending body member, or more than two outwardly extending body members, for example three or four or five, depending on the particular requirements for the anchoring system, such as for example the depth of the borehole 30.

Each of the two spaced apart outwardly extending body members 6*a*, 6*b* provides a bearing surface 7*a*, 7*b* such that in use an annular gap 32 for receiving locking media is defined between the bearing surfaces 7*a*, 7*b* and the adjacent portions of the borehole 30.

Each outwardly extending body member 6*a*, 6*b* comprises a first conical portion 8*a*, 8*b*, a tubular portion 9*a*, 9*b*, and a second conical portion 10*a*, 10*b* coaxial with the longitudinal axis (L) of the elongate main body 3.

Along the first conical portion 8*a*, 8*b* of each body member 6*a*, 6*b* the cross section of the elongate main body 3 increases in the direction from the upper end 4 to the lower end 5;

Along the second conical portion 10*a*, 10*b* of each body portion 6*a*, 6*b* the cross section of the elongate main body 3 decreases in the direction from the upper end 4 to the lower end 5.

The tubular portion 9*a*, 9*b* is located between the first conical portion Ba, 8*b* and the second conical portion 10*a*, 10*b*.

The first and second conical portions 8*a*, 8*b*, 10*a*, 10*b* define tapered sections provided the bearing surface 7*a*, 7*b*. It is however to be understood that the projecting members 6*a*, 6*b* may have any suitable shape or configuration to provide a bearing surface 7*a*, 7*b* suitable of supporting, abutting and retaining locking media.

Each of the first conical portion and second conical portion 8*a*, 8*b*, 10*a*, 10*b* provides a tapered section which extends at an angle to (i.e. defining the taper angle) the longitudinal axis (L) of the elongate main body 3.

In the illustrated embodiment, the first conical portion 8*a*, 8*b* is smaller than the taper angle of the second conical portion 10*a*, 10*b*. It is however to be understood that the taper angles of the first and second conical portions 8*a*, 8*b*, 10*a*, 10*b* may have any suitable angle depending on the particular requirements of the anchoring system 1.

Each conical portion 8*a*, 8*b*, 10*a*, 10*b* has a first free end and a second opposed end located at or adjacent the tubular portion 9*a*, 9*b*. The length of each conical portion 8*a*, 8*b*, 10*a*, 10*b* is measured between the first free end and the second opposed end thereof. It can be seen from FIGS. 1 and 3 that the first conical portion 8*a*, 8*b* has a greater length than the second conical portion 10*a*, 10*b*. It is however to be understood that each conical portion may have any suitable length depending on the particular requirements of the anchoring system.

In the illustrated embodiment, the cross-sectional dimensions of the second opposed ends of each conical portion 8*a*, 8*b*, 10*a*, 10*b* are substantially the same as the cross-sectional dimension of the tubular portion 9*a*, 9*b*. This helps to ensure that the anchoring system 1 can be inserted smoothly into the bore hole.

Each outwardly extending member 6*a*. 6*b* further comprises a plurality of spaced apart conduits 11*a*, 11*b* provided on outer surfaces thereof. The conduits 11*a*, 11*b* extend in a direction substantially parallel to the longitudinal direction L of the elongate main body 3. The conduits 11*a*, 11*b* extend along at least a portion of the first conical portion 8*a*, 8*b*, the tubular section 9*a*, 9*b*, and at least a portion of the second conical portion 10*a*, 10*b*.

In the illustrated embodiment, the conduits 11*a*, 11*b* are provided as channels. The channels 11*a* of the first projection member 6*a* are aligned with the channels 11*b* of the second projection member 6*b*. It is however to be understood that the channels may be located at any suitable position and can for example be offset from channels provided on other, for example adjacent, projecting members.

A cohesive high friction coating, such as for example bitumen, is provided on the tapered bearing surfaces 7*a*, 7*b* of the projecting members 6*a*, 6*b*. The cohesive high friction coating is configured to increase friction between the elongate main body 3 and locking media received within the annular gap.

Figure 3:
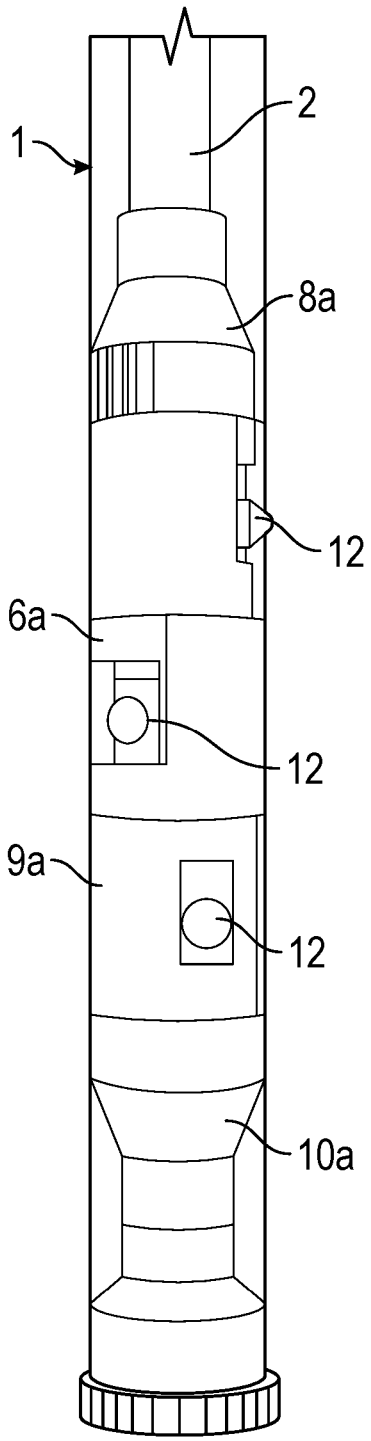
FIG. 3 shows a schematic illustration of an outwardly extending member of an anchoring system according to one embodiment of the present invention.
Figure 4:
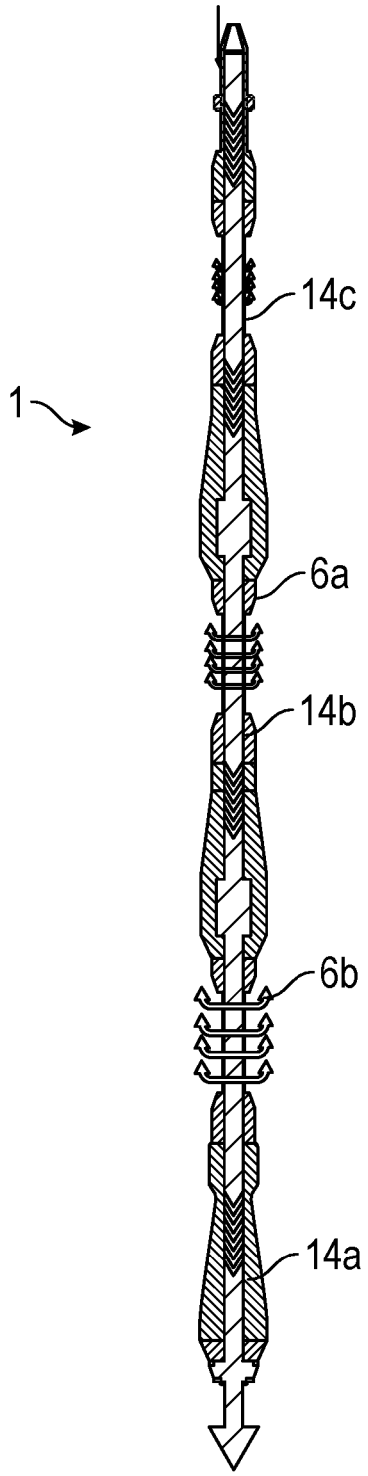
FIG. 4 shows a schematic illustration of the flowpath of locking media introduced via the anchoring system of FIG. 1.
Figure 5:
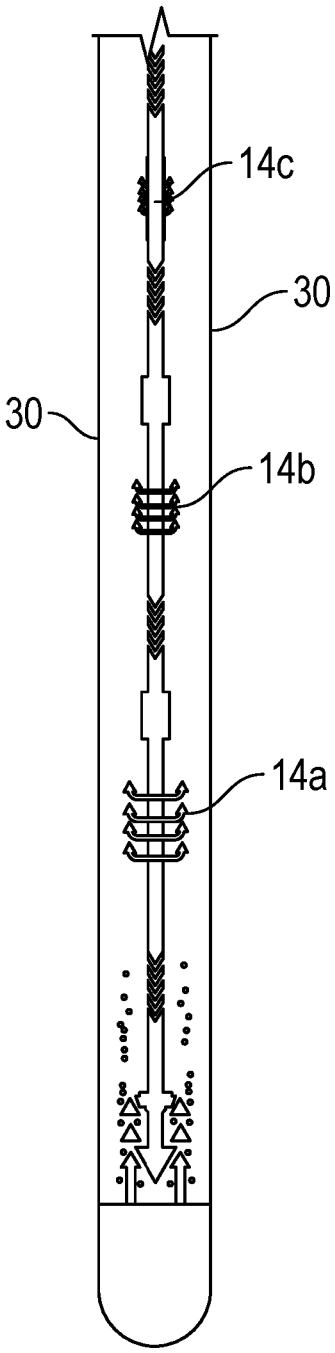
FIG. 5 shows a schematic Illustration of the flowpath of locking media introduced via the anchoring system of FIG. 1 within the borehole.

With reference to FIG. 3, in one embodiment, the outwardly extending body member 6*a* of the elongate main body 3 comprises fixing means 12 operative to penetrate an adjacent portion of a borehole 30 wall to establish a fixed connection therewith. It can be seen that the fixing means 12 are provided on the tubular section 9*a* of the member 6*a*. Although FIG. 3 only Illustrates the fixing means to be present on a single outwardly extending member 6*a*, it is to be understood that one or more, for example each, of the outwardly extending members 6*a*, 6*b* may comprise fixing means 12.

The fixing means 12 are operative to be driven outwardly or away from the elongate main body 3 to penetrate an adjacent portion of a borehole wall 30.

In the illustrated embodiment, the fixing means 12 are cone point bolts. It is however to be understood that the fixing means 12 may be any suitable fixing means 12 capable of being driven outwardly to penetrate a borehole wall 30.

The elongate main body 3, for example the or each outwardly extending body member 6*a*, 6*b*, may comprise one or more, preferably a plurality of, fixing means 12. The fixing means 12 may be spaced apart from each other along the length of the elongate main body 3, for example along the length of the outwardly extending body member 6*a*, 6*b* (or tubular section 9*a*, 9*b*).

One or more of the plurality of fixing means 12 is configured to extend at different angles with respect to the longitudinal axis of the corresponding elongate main body 3. The fixation of the elongate means has been found to be improved by the use of fixing means 12 which extend at a plurality of different angles from the elongate main body 3.

In use, as shown in FIGS. 4 to 9, the method of installing an anchor pile 2 into a borehole 30 drilled in the seabed for creating a mooring anchorage, comprises running the anchor pile 2 as herein described through the borehole 30 until the anchor pile 2 is entirely received within the borehole 30 prior to insertion of locking media. The upper end 4 of the elongate main body 3 is entirely received within the borehole 30 and located at a predetermined depth beneath the surface of the seabed. In one embodiment, the anchor pile 2, for example the lower end 5 of the elongate main body 3, contacts the bottom of the borehole 30.

During installation, a guide collar 20 providing a guide channel 21 extending therethrough is placed in position at the opening of the borehole 30. The guide channel 21 is aligned within the borehole 30. The anchor pile 2 is aligned with and inserted through the guide channel 21 of the guide collar 20 into the opening of the borehole 30. The anchor pile 2 is then driven into the borehole 30. The guide collar 20 is then removed from the anchor pile 2.

The locking media may be provided in a fluid medium directly into the annular gap 32 from an upper section of the borehole 30. Alternatively, or in addition, the locking media may be provided in a fluid medium into the annular gap 32 from a lower portion of the elongate main body 3. The elongate main body 3 of the anchor pile 2 is shaped as an essentially tubular hollow body, as shown in FIGS. 4 to 8, and the locking media is provided as fluid and/or sediments pumped from inside the borehole 30 through the hollow tubular main body 3.

As shown in FIGS. 4 to 8, the elongate main body 3 comprises a plurality of, ports 14*a*, 14*b*, 14*c* arranged over its length. Each port 14*a*, 14*b*, 14*c* is configured for establishing a fluidic communication between an inner volume of the elongate main body 3 and the adjacent annular gap 32. Locking media may be provided into the annular gap in a fluid medium through the elongate main body 3. In the illustrated embodiment, locking media is provided through the upper end 4 of the elongate main body 3 (for example hollow tubular main body) towards the lower end 5 thereof. The fluid may for example be pumped through the inner volume of the main body 3 through the port(s) 14*a*. 14*b*, 14*c* to provide the locking media in a fluid medium into the annular gap 32.

Figure 6:
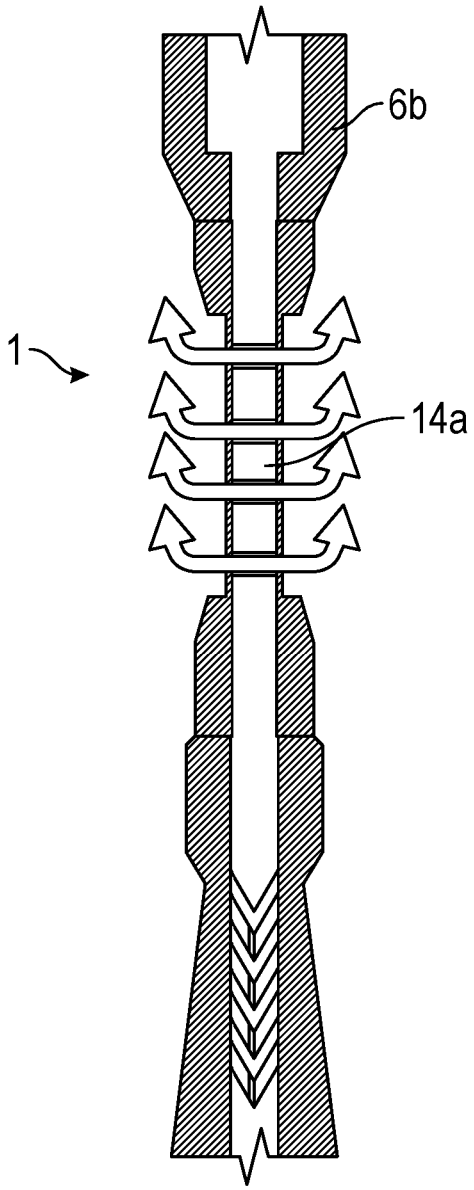
FIG. 6 shows a schematic illustration of the flowpath of locking media introduced via the anchoring system of FIG. 1 towards the lower end of the anchoring system.
Figure 7:
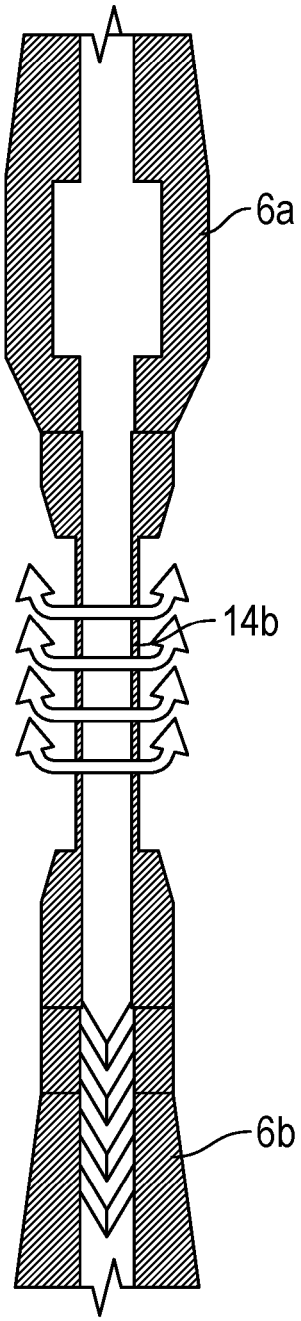
FIG. 7 shows a schematic illustration of the flowpath of locking media introduced via the anchoring system of FIG. 1 towards a central region of the elongate body member of the anchoring system.
Figure 8:
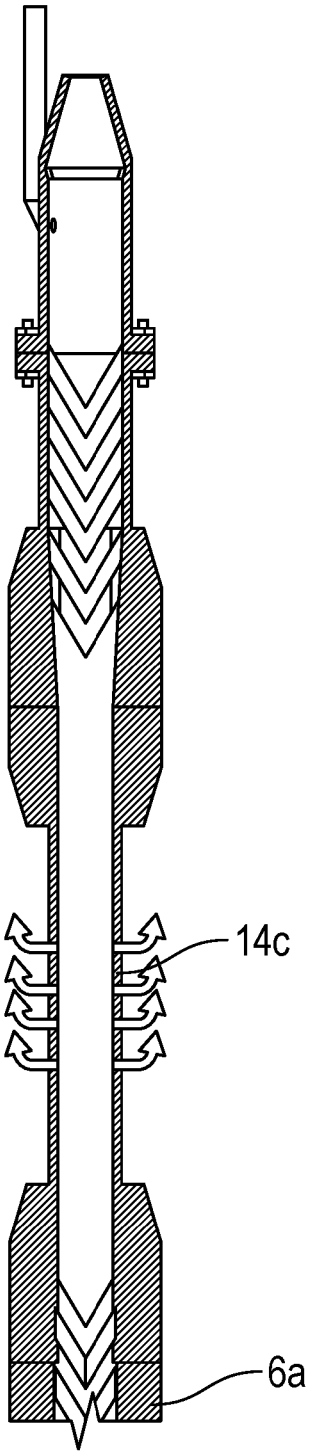
FIG. 8 shows a schematic illustration of the flowpath of locking media introduced via the anchoring system of FIG. 1 towards the upper end of the anchoring system.
Figure 9:
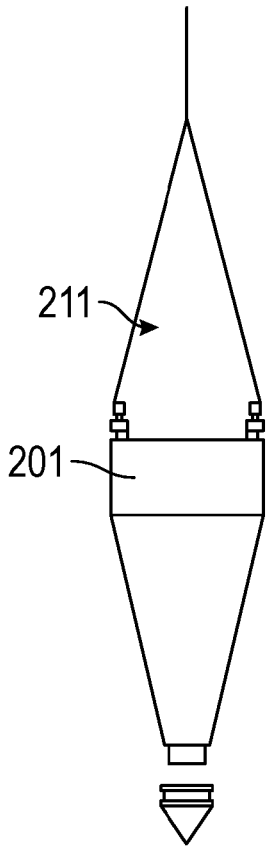
FIG. 9 shows a schematic illustration of the guide collar according to one embodiment of the present invention.

It can be seen from FIGS. 6 to 8 that the size of the ports 14*a*, 14*b*, 14*c* decreases with distance away from the lower end 5 of the elongate main body 3. The ports 14*a* provided towards the lower end 5 of the elongate main body 3 (as shown in FIG. 6) are larger in dimension than the ports 14*b* provided towards a central region of the elongate main body 3 (as shown in FIG. 7). Furthermore, the ports 14*b* provided towards a central region of the elongate main body 3 (as shown in FIG. 7) are larger in dimension than the ports 14*c* provided towards the upper end 4 of the elongate main body 3 (as shown in FIG. 8). This arrangement enables the anchoring system 1 of the present invention to provide unique fluid placement methodology in which the locking media is provided to fill the borehole 30, and the annular gap(s) 32 preferentially and sequentially from the lower end 5 of the anchor pile 2 sequentially upwards towards the upper end of the anchor pile 2. With this arrangement, the supplied locking media preferentially exits the elongate main body 3 through the largest ports 14*a* located towards the lower end 5 of the elongate main body 3. As the locking media fills the annular gap 32 at or adjacent the largest ports 14*a* towards the lower end 5 of the elongate main body 3, the increased pressure causes the locking media to exit through slightly smaller ports 14*b* provided further along the elongate main body 3 in a direction towards the upper end 4 thereof. As the locking media fills the annular gap 32 at or adjacent the slightly smaller ports 14*b*, the increased pressure causes the locking media to exit through progressively smaller ports 16*c* located along the elongate main body 3 towards the upper end 4 thereof, sequentially filling the adjacent annular gaps 32. The present invention therefore provides an anchoring system 1 which can be used to efficiently and reliably fill annular gaps formed between multiple bearing surfaces located along the length of the elongate main body 3 and adjacent portions of the borehole 30. The present invention is therefore able to securely fix the anchor pile 2 in position within the borehole 30.

Figure 10:
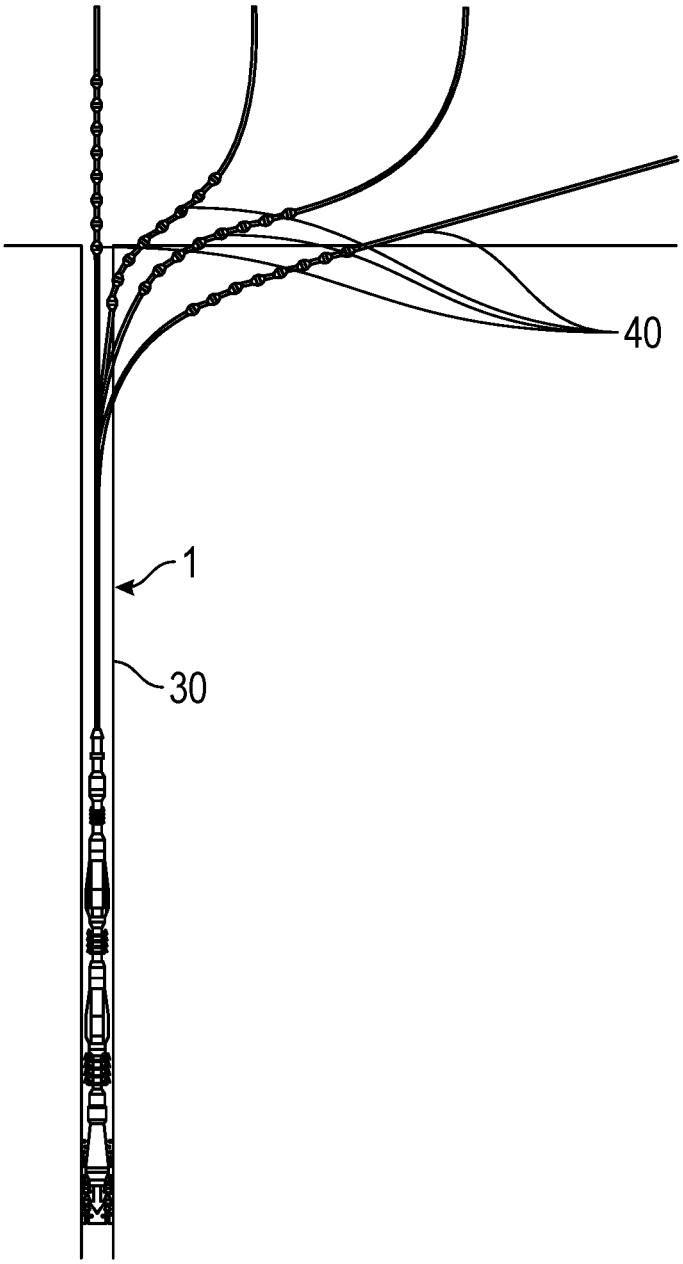
FIG. 10 shows a schematic illustration of progression over time of the anchoring system of FIG. 1 secured within a borehole.

Once securely fixed, the mooring line 40 attached to an upper end 4 of the anchor pile 2 is placed under sufficient tension and may progressively cut through the surrounding soil structure, as shown in FIG. 10, to form a catenary profile. As a result, the elongate main body experiences a reduction in axial forces and therefore risk of catastrophic failure is significantly reduced. Although the invention has been described primarily with reference to subsea applications, it will be understood by those skilled in the art that the invention is not limited thereto.

What is claimed is:

1. An anchoring system (1) comprising:

an anchor pile (2) configured to be embedded in a borehole (30) drilled in a seabed, the anchor pile (2) comprising an elongate main body (3) either being free of joints or comprising one or more joints formed along the elongate main body (3), the elongate main body (3) having a longitudinal axis (L) and comprising an upper end (4) and a lower end (5), wherein the upper end is configured in use to be fully submerged within the borehole (30); and one or more portions located on the elongate main body (3) of the anchor pile (2) between opposing ends of the elongate main body, the one or more portions each having a cross section greater than the cross section of the elongate main body (3) and the one or more joints formed thereon, and in which the cross section of the one or more portions increases along a portion of the longitudinal axis (L) in the direction from the upper end (4) to the lower end (5) defining at least one bearing surface (7*a*, 7*b*) such that in use an annular gap (32) for receiving locking media is defined between the at least one bearing surface (7*a*, 7*b*) and the adjacent portions of the borehole (30), and in which the anchor pile (2) is locked in position within the borehole (30) on receipt of locking media within the annular gap (32) as a result of sufficient frictional resistance arising from the abutment of the locking media with the bearing surface (7*a*, 7*b*) and suitable load bearing soil layers of the borehole (30).

2. The anchoring system (1) according to claim 1, in which the bearing surface (7*a*, 7*b*) comprises at least one tapered section.

3. The anchoring system (1) according to claim 1, wherein the elongate main body (3) comprises at least one protruding section (6*a*, 6*b*) projecting outwardly from the elongate main body (3) and/or at least one angled face sloping down outwardly from the elongate main body (3).

4. The anchoring system (1) according to claim 1, wherein the elongate main body (3) comprises at least one conduit (11*a*, 11*b*) arranged essentially parallel to the longitudinal axis (L), such that the conduit (11*a*, 11*b*) extends along the portion of the longitudinal axis (L) of the elongate main body (3) along which the cross section of the elongate main body (3) increases, the at least one conduit (11*a*, 11*b*) defining a channel between an upper section and a lower section of the elongate main body (3) thereby.

5. The anchoring system (1) according to claim 1, wherein the elongate main body (2) comprises:

a first conical portion (8*a*, 8*b*) coaxial with the longitudinal axis (L) of the elongate main body (3), wherein along the first conical portion (8*a*, 8*b*) the cross section of the elongate body (11) increases in the direction from the upper end (4) to the lower end (5);

a second conical portion (10*a*, 10*b*) coaxial with the longitudinal axis (L) of the elongate main body (3), wherein along the second conical portion (10*a*, 10*b*) the cross section of the main body (3) decreases in the direction from the upper end (4) to the lower end (5); and a tubular portion (9*a*, 9*b*) coaxial with the longitudinal axis (L) of the elongate main body (3), extending between the first conical portion (8*a*, 8*b*) and the second conical portion (10*a*, 10*b*).

6. The anchoring system (1) according to claim 1, wherein at least a portion of the elongate main body (3) of the anchor pile (2) comprises a cohesive coating configured to increase friction between the elongate main body (3) and locking media received within the annular gap (32).

7. The anchoring system (1) according to claim 1, wherein at least a section of the elongate main body (3) comprises fixing means (12), configured for being driven outwardly from the elongate main body (3) for penetrating the borehole (30) wall, such that a fixed connection is established thereby.

8. The anchoring system (1) according to claim 1, wherein the elongate main body (3) of the anchor pile (2) is shaped as an essentially tubular hollow body comprising a plurality of ports (14*a*, 14*b*, 14*c*) arranged over at least a portion of its length, the ports (14*a*, 14*b*, 14*c*) being configured for establishing a fluidic communication between an inner volume of the elongate main body (3) and the annular gap (32) defined between the elongate main body (3) and the borehole (30).

9. The anchoring system (1) according to claim 1, wherein a mooring line termination point of a mooring line (40) is integrally connected to the upper end (4) of the elongate main body (5) of the anchor pile (2), such that the mooring line (40) is concentric and axially aligned with the longitudinal axis (L) of the elongate main body (3).

10. The anchoring system (1) according claim 1, further comprising a guide collar (20) configured for being arranged at the opening of the borehole, the guide collar (20) providing a guide channel (22) configured in use to be aligned with the borehole (30) and to enable the anchor pile (2) to pass therethrough into the borehole (30), and in which the guide collar (20) is configured to be removable from the anchor pile (2) once positioned within the borehole (30).

11. The anchoring system (1) according to claim 10, in which the guide collar (20) comprises a first end configured to contact the borehole (30), and a second opposed end, and in which the guide collar (20) further comprises a slot extending between the first and second ends thereof, and in which the slot is in communication with the guide channel (22).

12. A method of installing an anchor pile (2) into a borehole (30) drilled in the seabed for creating a mooring anchorage, the method comprising the steps of:

i. providing an anchoring system (1) according to claim 1; and ii. at least partially filling the annular gap (32) defined between the bearing surface (7*a*, 7*b*) of the elongate main body (3) of the anchor pile (2) and the adjacent borehole (300) wall with locking media to lock the anchor pile (2) in place.

13. The method of installing an anchor pile (2) as claimed in claim 12, further comprising running the anchor pile (2) through the borehole (30) until the anchor pile (2) is entirely received within the borehole (30) prior to insertion of locking media.

14. The method of installing an anchor pile (2) as claimed in claim 12, further comprising:

iii. introducing the lower end (5) of the elongate main body (3) through a guide channel of a guide collar (20), into the borehole (30); and iv. removing the guide collar (20) from the anchor pile (2).

15. The method according to claim 12, wherein in the locking media is provided in a fluid medium directly into the annular gap (32) from an upper section of the borehole (30).

16. The method according to claim 15 wherein the elongate main body (3) of the anchor pile (2) is shaped as an essentially tubular hollow body, wherein the locking media is provided as fluid and/or slurry pumped through the hollow tubular main body and into the annular gap (32) between the elongate main body (3) and the borehole (30).

17. The method according to claim 16, wherein the elongate main body (3) comprises a plurality of ports (14*a*, 14*b*, 14*c*) arranged over at least a portion of its length, the ports (14*a*, 14*b*, 14*c*) being configured for establishing a fluidic communication between an inner volume of the elongate main body (3) and the annular gap (32) and wherein the locking media is provided in a fluid medium through the upper end (4) of the hollow elongate main body (3), the fluid being pumped through the inner volume of the elongate main body (3) through the ports (14*a*, 14*b*, 14*c*) to provide the locking media in a fluid medium into the annular gap (32).

18. The method according to claim 17, in which the elongate main body (3) comprises a plurality of ports (14*a*, 14*b*, 14*c*) arranged over at least a portion of its length, in which the size of the ports (14*a*, 14*b*, 14*c*) decreases with distance away from the lower end (5) of the elongate main body (3).

19. The method according to claim 12, further comprising the step of providing cement grout aggregate material into the borehole (30) prior to inserting the anchor pile (2) into the borehole (30).

* * * * *